United States Patent [19]

Aiuola et al.

[11] Patent Number: 4,621,480

[45] Date of Patent: Nov. 11, 1986

[54] TRANSFER DEVICE FOR WRAPPING MACHINES

[75] Inventors: Franco Aiuola; Luciano Nannini, both of Bologna, Italy

[73] Assignee: Azionaria Costruzioni Macchine Automatiche (ACMA), Bologna, Italy

[21] Appl. No.: 632,091

[22] Filed: Jul. 18, 1984

[30] Foreign Application Priority Data

Aug. 8, 1983 [IT] Italy ..... 3530 A/83

[51] Int. Cl.[4] ..... B65B 11/28

[52] U.S. Cl. ..... 53/234; 53/225

[58] Field of Search ..... 53/148, 225, 234; 198/468.9

[56] References Cited

U.S. PATENT DOCUMENTS

| | | | |
|---|---|---|---|
| 1,946,697 | 2/1934 | Johnson | 53/234 |
| 2,375,655 | 4/1945 | Brunander | 53/234 |
| 4,258,528 | 3/1981 | Focke | 53/230 X |
| 4,351,142 | 9/1982 | Focke | 53/575 |

FOREIGN PATENT DOCUMENTS

| | | | |
|---|---|---|---|
| 1078494 | 9/1960 | Fed. Rep. of Germany | 53/148 |

*Primary Examiner*—John Sipos

*Attorney, Agent, or Firm*—Alan N. McCartney

[57] ABSTRACT

A device for use in machines for wrapping blocks e.g. soap tablets (1) comprising a drum (3) which rotates intermittently and has diametrically opposed seatings (4) for the tablets (1), a station (6) for receiving a tablet (1) expelled from an adjacent seating (4) partially wrapped in an associated piece of wrapping paper (2), and means (11, 12) for removing the tablets (1) in succession from the station (6). The device comprises a hopper (20) movable alternately between the station (6) and a position remote from it, in register with the path of transport means (11,12) and orientated relative to the path so that the hopper (20) can be intercepted by pushers (12) of the transport means (11,12), the hopper (20) being arranged to receive a tablet (1) and its associated piece of wrapping paper (2) expelled from the drum (3) at the station (6) and to deliver them into said remote position to be engaged and carried away by a pusher (12) of the transport means (11,12).

3 Claims, 10 Drawing Figures

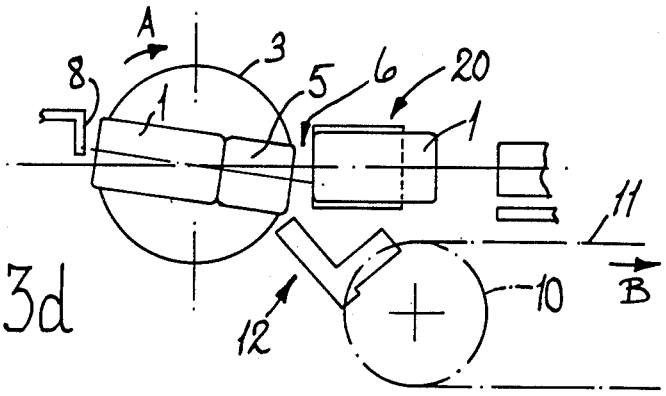
Fig_3d
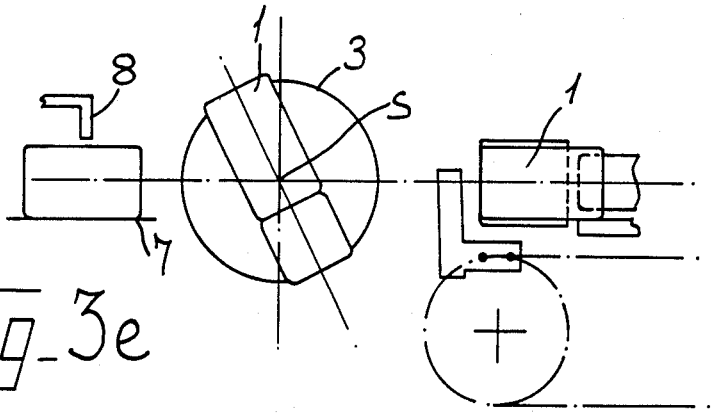
Fig_3e
Fig_5a
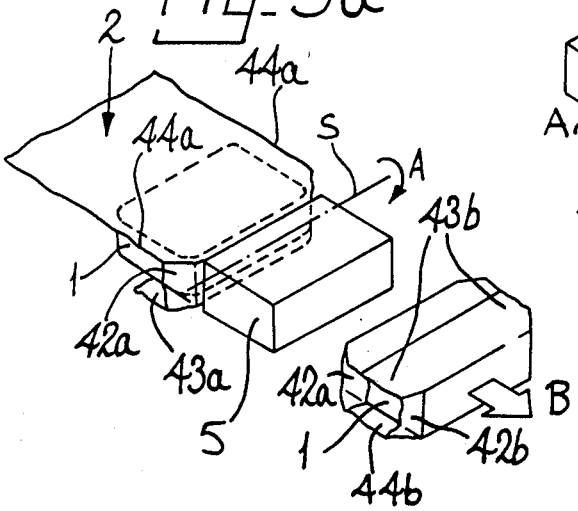
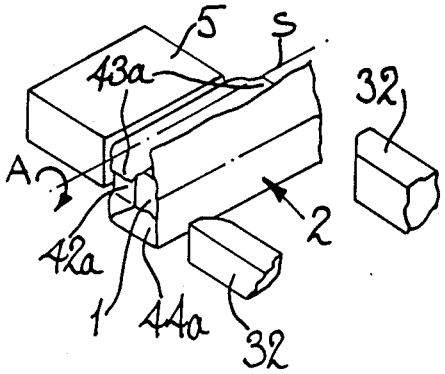
Fig_5b

TRANSFER DEVICE FOR WRAPPING MACHINES

FIELD OF THE INVENTION

The present invention is concerned with a device which, in machines for wrapping single blocks of approximately parallelepiped shape, for example soap tablets, receives the tablets from one part of the machine and transfers them to a further part of the machine.

BACKGROUND OF THE INVENTION

In some types of machine for wrapping soap tablets or similar blocks it has been proposed, for example in our co-pending Patent Application Ser. No. 537,184, filed 29th Sept. 1983, to push the tablets gradually into a seating; the seatings are diametrically opposed in a drum which rotates at intervals and is stationary during the insertion of a table. During insertion, the tablet contacts a piece of wrapping paper which is folded as the tablet is inserted so that the paper is partially wrapped around the lateral surfaces of the tablet and, adjacent the ends of the tablet, outlines pairs of a type of end flap. As a tablet is inserted into a seating of the drum a previous tablet with its associated piece of wrapping paper folded around it, as stated, is expelled from the opposite seating. During exit of the tablet from the drum, the wrapping of the piece of paper around the tablet and the formation of the pairs of end flaps is completed; the tablet is then carried away by transport means. Each pair of end flaps is folded one over the other as the tablet travels along the transport means, and the sealing of the wrapping paper e.g. by heat sealing is carried out. Conveniently the transport means comprises chains, fitted with external pushers which, spaced slightly from the drum, engage in succession the tablets leaving the drum. It is desirable that, having left the drum, each tablet is transported by the transport means without its orientation being changed and without its wrapping paper losing the shape which it has already assumed in any way. Delivery of the tablets to the transport means under adequate control, has not heretofore always been sufficiently reliable.

OBJECTS OF THE INVENTION

One of the objects of the present invention is to provide a device for transferring blocks, for example soap tablets, e.g. which leave a drum of a wrapping machine of the type outlined above partially wrapped, to transport means, e.g. a chain having pushers, reliably under control.

SUMMARY OF THE INVENTION

The invention relates to a transfer device especially suitable for use in a machine for wrapping blocks of approximately parallelepiped shape comprising a drum which rotates intermittently and has diametrically opposed seatings for the blocks, a station for receiving a tablet expelled from an adjacent seating with an associated piece of wrapping paper partially wrapped around it and outlining pairs of a type of end flap at regions corresponding respectively with the ends of the block, and means arranged to remove the tablets in succession from the station. The transfer device according to the invention comprises a type of hopper, part, at least, of which preferably is resiliently mounted, and which is movable alternately between the receiving station at which the hopper receives a block from the drum and a position remote from that station in register with the path of transport means and orientated relative to the path so that the hopper can be intercepted by pushers of the transport means as the transport means operates, the hopper being arranged to receive a block and its associated piece of wrapping paper at the station and to deliver them into said remote position to be engaged and carried away by a pusher of the transport means. Suitably the path of the transport means is in horizontal alignment with the seating when the drum is stationary to expel tablets into the hopper at the receiving station.

The hopper of a device according to the invention, may suitably comprise lower support means, suitably a pair of lower plates separated from one another by a passage for pushers of transport means, a pair of support members secured to and projecting upwardly from portions of the associated one of the lower support means, a pair of folder members attached to an associated one of the support members and facing inwardly towards one another, and an upper member, suitably an upper plate resiliently mounted from upper end portions of the support member, the upper plate and the pair of folder members being so constructed and arranged as to complete the wrapping of the piece of wrapping paper around the block and to complete the end flaps as the block and wrapping paper are introduced into the hopper, and the hopper being so constructed and arranged as to provide spaces for upper ones of the end flaps between said upper plate and the pair of folder members and for lower ones of the end flaps between the folder members and the lower plates. In a device according to the invention the two lower plates preferably project from respective rods which extend downwardly below the path of an operative upper run of the transport means and are connected by a cross member which is disposed between the upper and lower runs of the transport means, the cross member being mounted for sliding movement on a guideway, suitably provided by two rods, parallel to the upper run and being operated to move along the guideway to and fro between the station and the remote position by suitable driving means, for example a connecting rod of cam mechanism itself driven by the motive power of a wrapping machine in which the device comes to be incorporated. Conveniently the upper plate of a hopper of the type described above may be suspended by means of a parallel linkage system articulated to a cross member extending between upper end portions of support members and the hopper may comprise spring means which urge the upper plate of the hopper towards a lowered position, the spring means extending between the plate and cross member, whereby the upper plate is resiliently mounted.

Where a device according to the invention is mounted in a wrapping machine of the type hereinbefore described, comprising a drum, the construction and arrangement is such that whilst the drum is halted and a tablet is being expelled from it at the station, the hopper of the device completes a return course to the station and then remains stationary at the station for a time, and whilst the drum is in rotation, the hopper moves to its remote position and remains there so as to be intercepted by one of the pushers of the transport means which removes the tablet and its associated piece of wrapping paper from the hopper.

A device according to the invention is conveniently simple in construction, compact and may readily be mounted in suitable wrapping machines. Furthermore, a device according to the invention is preferably so constructed and arranged as to be readily adjusted to accommodate different shapes and sizes of block.

BRIEF DESCRIPTION OF THE DRAWINGS

There now follows a detailed description, to be read with reference to the accompanying drawings, of part of a wrapping machine including a device embodying the invention. It will be realised that this wrapping machine has been selected for description to illustrate the invention by way of example.

In the accompanying drawings:

FIGS. 3*a* to 3*e* are diagrammatic side views of the wrapping machine showing various steps in the operation of the wrapping machine and transfer device;

FIGS. 5*a* and 5*b* are diagrammatic perspective views showing a soap tablet at various stages in the wrapping of the tablet.

DESCRIPTION OF THE PREFERRED EMBODIMENT

Figure 1:
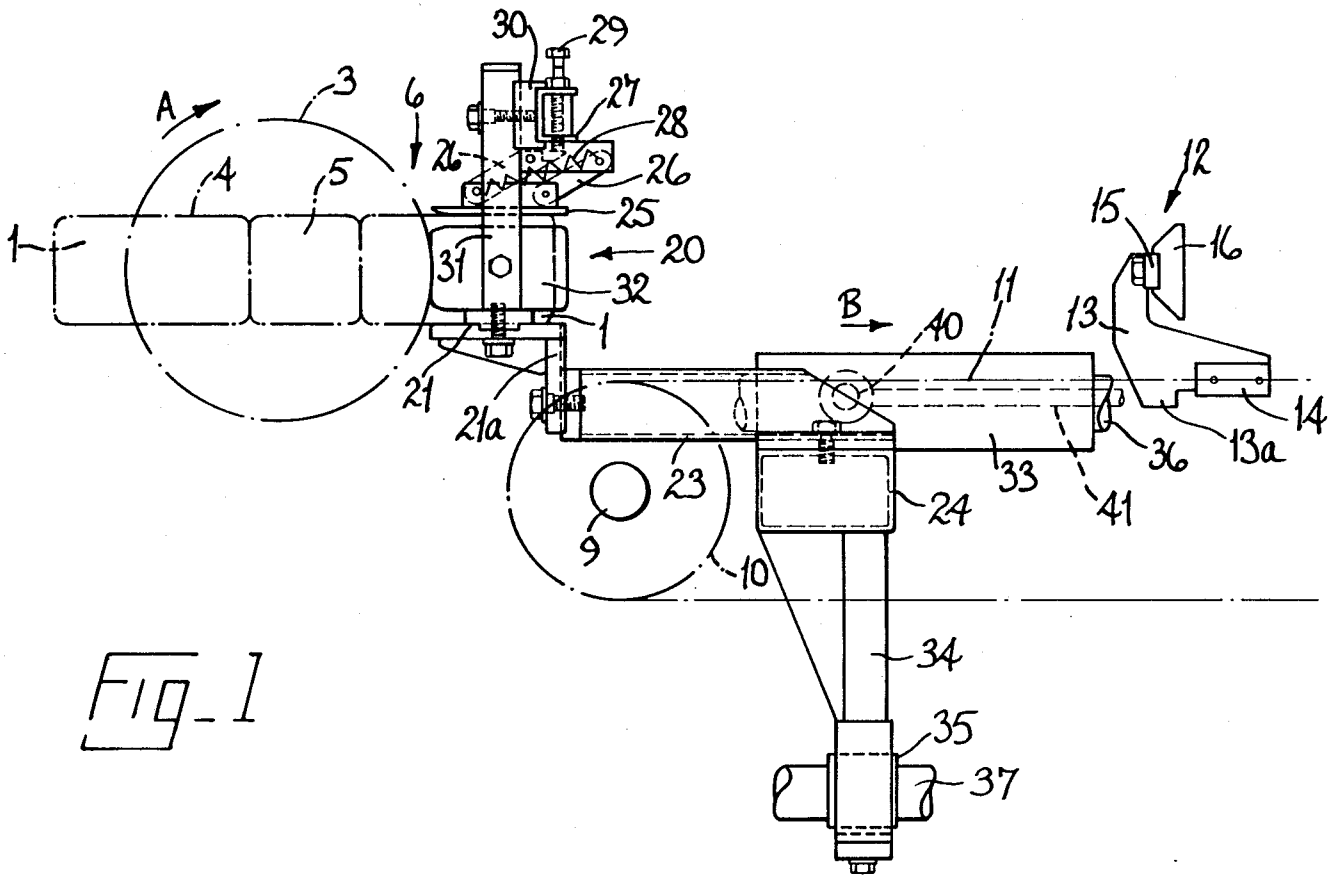
FIG. 1 is a view in side elevation of a wrapping machine showing a transfer device embodying the invention.
Figure 2:
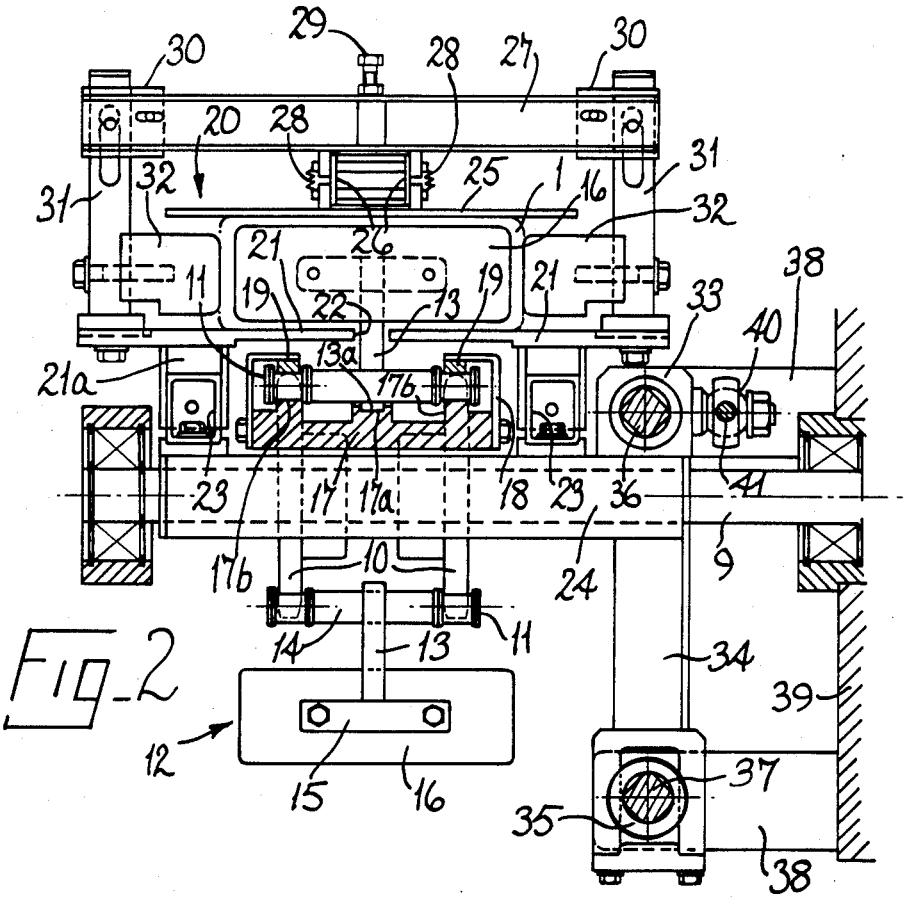
FIG. 2 is a view in front elevation of the wrapping machine showing the transfer device.

The wrapping machine shown in the drawing is suitable for use in wrapping blocks of substantially parallelepiped shape, for example soap tablets 1, which are intended to be wrapped in an associated piece of wrapping paper 2 (see FIGS. 5*a* and 5*b* in which is shown only a single sheet of external wrapping paper of a heat-sealable type; such a sheet is often accompanied by an inner sheet of paper, not shown in the drawings). The wrapping and enclosing of the tablets 1 in the wrapping paper 2 takes place in a suitable wrapping machine, for example of the type described in our aforementioned co-pending patent application, parts of which are shown generally diagrammatically in the accompanying drawings.

The wrapping machine embodying the invention shown in the drawings comprises a drum 3 which is rotated intermittently around a horizontal axis s in the direction indicated an an arrow A. The drum 3 presents diametrically opposed seatings 4 for the above mentioned tablets 1. The seatings 4 are provided by a passage which extends diametrically through the drum 3 and which is partly occupied by a block 5 mounted in the passage for sliding movement in a diametrical direction, in a frictional manner. The passage in the drum and the block 5 are so arranged that a single tablet 1 is wholly contained in one of the seatings of the passage which is not occupied by the block 5, the block at that time occupying the other one of the seatings. Each time the drum 3 halts, the seating 4 at one end of the passage faces towards a tablet which is to be pushed into the seating, whilst the seating at the other end of the passages faces a receiving station 6 into which the preceding block contained in the adjacent seating 4 can be expelled from the drum. A line T2 of diagram T in FIG. 4, corresponds to one stationary point in the operation of the drum; a line T1 in the same diagram corresponds to rotation of the drum 3 (in particular through 180°) by means of which one of the two seatings 4 is moved from its discharge position adjacent the station 6 and the other of the seatings 4 is advanced to the discharge position, adjacent the receiving station 6.

The tablets 1 are supplied one after another on a conveyor belt 7 which extends parallel to the axis s of the drum 3; the next tablet which is to be pushed into the drum is stopped by engagement with a suitable barrier (not shown) which extends across the conveyor belt so that the tablet 1 abutting the barrier is in register with the drum. Between this tablet and the drum 3 a piece of wrapping paper 2 is placed by a vertical positioner (not shown), so that the tablet can be moved into engagement with the wrapping paper 2 when pushed in an appropriate direction by a pusher 8 (see FIG. 3) of the wrapping machine. The pusher 8 of the wrapping machine has a complex motion in that it may move both horizontally and vertically (shown respectively in the diagrams SO and SV of FIG. 4 in relation to diagram T).

A shaft 9 of the wrapping machine is mounted on a frame 39 of the machine for free rotation about an axis parallel to the axis s of the drum 3, just below the station 6. The shaft 9 carries a pair of sprocket wheels 10 which form part of driving means for a pair of chains 11. The driving means also comprises means (not shown) for moving the chains 11 continuously so that an operative upper run of the chains 11 moves in a direction B (see FIG. 1 and FIGS. 3*a* and 3*d*). Outwardly projecting pushers 12 are secured to the chains 11 spaced at regular intervals along the chains. Transport means, comprising the chains 11 and pushers 12 are intended, as will be explained in more detail later, to remove tablets in succession supplied from the station 6.

Each pusher 12 comprises a flat, shaped element 13 which lies in a vertical plane longitudinal to the chains 11 and which is mounted on a cross member 14 attached to and extending between a link of each of the chains 11. Secured to an outer end portion of the element 13 is a rear fixing cross member 15 for a pushing plate 16. The element 13 has a small projection 13*a* which is received and guided in a longitudinal groove 17*a* along the upper run of the chains 11. The groove 17*a* is formed in a lengthwise member 17 which also provides two flat bearing surfaces 17*b* and which, by means of brackets 18, supports opposed bearing surfaces 19; such bearing surfaces 17*b*, 19 support and guide the upper runs of the chains 11.

The transfer device embodying the invention shown in the drawings is arranged to receive tablets 1 expelled from the seatings 4 in the drum 3 and transfer them to the transport means 11, 12. The transfer device comprises a kind of resilient hopper 20 having lower support means comprising two plates 21 which lie in the same horizontal plane above the chains 11 and which are separated from one another by a passage 22 along which the shaped elements 13 of the pushers 12 are able to travel. Each plate 21 has a downwardly projecting section 21*a* at a central portion of its edge remote from the drum 3, in which one end of an associated bar 23 of rectangular cross section is received and secured. Starting from the associated sections 21*a*, the two bars 23 extend down stream, parallel to and outwardly of the upper runs of the chains 11. The other ends of the bars are fixed to a common cross member 24 which is disposed between the upper and lower runs of the chains 11. The hopper 20 further comprises a resiliently mounted upper plate; in the transfer device described the upper plate 25 is suspended from a cross member 27 by means of two pairs of pivoting arms 26 in a parallel linkage system, the pivot axes of which are horizontal and transverse to the chains 11.

The upper plate 25 is urged towards a lowered position by tension springs 28 acting between the plate 25 and the cross member 27; the lowered position is defined by contact between a projection of the pivoting arm 26 and an adjusting screw 29, self-tapped to the cross member 27. The ends of the cross member 27 are mounted in horizontal grooves of associated blocks 30 and are secured to the blocks 30 with a possibility of limited adjustment lengthwise of the cross member 27 by screw and slot means. The blocks 30, in addition to the horizontal grooves on one face, have vertical grooves on the opposite face; upper end portions of support members, namely pillars 31, are received in the vertical grooves and the blocks 30 are secured to the pillars 31, with a possibility of limited vertical adjustment, by screw and slot means, thus rendering the height of the cross member 27 and plate 25 adjustable. The base of each pillar 31 is secured in a groove at an outer edge portion of the associated one of the lower plates 21, for adjustment transversely of the hopper.

The transfer device further comprises two members, namely blocks 32, each of which blocks 32 is secured to a corresponding one of the pillars 31; the blocks 32 have the function of folder members in the operation of the transfer device. The blocks 32 face inwardly, opposite one another and are disposed between the lower plates 21 and the upper plates 25. Thus the hopper 20 is defined at the bottom by the plates 21, laterally by the blocks 32 and at the top by the resiliently mounted plate 25 and is orientated parallel to the chains 11.

The hopper 20 is movable, still remaining parallel to the chains 11, alternately between the receiving station 6 and a remote position down stream of, and a little removed from, the station 6. A coupling 33, located externally of, and parallel to, one of the bars 23 is integral with the cross member 24 at one end portion thereof. From the same end portion an arm 34 projects downwardly. The arm 34 carries a bushing 35; the coupling 33 and the bushing 35 are slideably mounted on ways provided by associated rods 36, 37 parallel to the chains 11. End portions of the rods 36,37 are mounted in brackets 38 of the frame 39 of the wrapping machine. A connecting rod 41 is pivotally mounted on the coupling 33 by pivoting means 40 and forms part of a cam mechanism which is driven by the motive power of the wrapping machine in which the transfer device is incorporated and which determines the alternate stroke of the hopper 20 of the transfer device as shown in the diagram D (FIG. 4).

Figure 4:
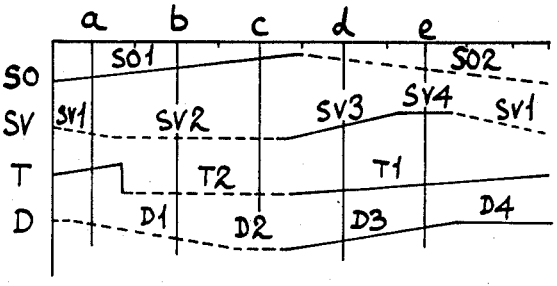
FIG. 4 is a diagrammatic view showing the operative sequence of the wrapping machine.

Considering now FIGS. 3*a* to 3*e*, 4 and 5*a* and 5*b* in detail, and the function of the transfer device for receiving soap tablets and transferring the tablets, relative to the operation of other parts of the wrapping machine, it will be noted that the reference letters on the vertical reference lines of FIG. 4 correspond with the index letters of FIGS. 3*a* to 3*e*.

When the pusher 8 is about to end its descent (line SV1 of diagram SV, FIG. 4) it starts its operative stroke (line SO1 of diagram SO, FIG. 4) by moving in the direction B so that it approaches a tablet 1 to be transferred when the belt 7 has brought the tablet 1 to abut against the stationary barrier (not shown) in a transfer position. Meantime (see FIG. 3*a* and reference a of FIG. 4) the drum 3 is about to complete a rotation (line T1 of FIG. 4) of one half turn (180°), the hopper 20 has just started its return stroke (line D1 of diagram D) in the direction opposite to direction B and the belt 7, which is driven intermittently, has stopped so that the tablet 1 to be transferred is not under any load from the following tablets carried by the belt. Having engaged the tablet 1 to be transferred, the pusher 8 follows its operative path horizontally (see line SV2 of FIG. 4) and pushes the tablet 1 into contact (as previously mentioned with a piece of wrapping paper 2 positioned vertically and then inserts both these into the drum 3. The drum will have stopped with the seatings 4 horizontal and the one of the seatings 4 at which the block 5 is located facing toward the tablet 1 abutting the stationary barrier. Whilst the tablet 1 is being inserted into the drum 3 by operation of the pusher 8, the tablet displaces the block 5 towards the other end of the passage which provides the seatings 4, that is towards the station 6. Furthermore (see the left hand part of FIG. 5*a*) the piece of wrapping paper 2 is caused to be partially wrapped around the lateral surfaces of the transferred tablet 1 and, at regions corresponding with each end of the tablet, is made to form a re-entrant fold 42*a* and to form outlines 43*a* and 44*a* of end flaps. By the displacement of the block 5 as the new tablet is inserted into the seating 4 (FIGS. 3*b* and 3*c*) to the seating 4 adjacent the station 6, the block 5 expels a tablet from the seating adjacent the station 6, this tablet having previously been partially wrapped in a piece of wrapping paper as hereinbefore described. The hopper 20, which has completed its return stroke and which then (see line D2 of diagram D) has a brief stationary period at the station 6, receives the tablet expelled from the seating 4 of the drum 3. The plates 21, 25 and blocks 32 of the hopper are suitably shaped at inlet regions facing the drum 3 (FIG. 1) to facilitate entry of the tablet into the hopper 20. By action of the upper plate 25 as the tablet is introduced into the hopper 20, the wrapping of the wrapping paper 2 around the tablet being expelled from the drum is completed and, by the action of the blocks 32, which are in register with each end of the tablet, a further re-entrant fold 42*b* is formed and the pairs of end flaps, now indicated by 43*b* and 44*b* (see FIG. 5) are completed. The end flaps 44*b* are intended to be accommodated in spaces existing between the lower plates 21 and the blocks 32 and the end flaps 43*b* are intended to be accommodated between the blocks 32 and the upper plates 25.

The pusher 8 terminates its outward stroke a little after it is raised (line SV3 of SV in FIG. 4); rotation of the drum 3 and the outward stroke (line D3 of D in FIG. 4) of the hopper 20 with the tablet 1 contained in it, has then started. As soon as its outward stroke is complete, the pusher 8 (FIG. 3*d*) starts its return stroke (line SO2 of SO in FIG. 4); in the meantime a pusher 12 is carried into the station 6. Shortly after, (FIG. 3*e*) whilst the pusher 8 and the drum 3 continue the return stroke and the rotation respectively, and whilst the hopper 20 is about to reach its position remote from the station 6, the pusher 8 has already reached its highest position and remains at such a level for a certain length of time (line SV4 of SV, FIG. 4). A new tablet 1, carried by the belt 7, can pass under the pusher 8 and be carried along until it is stopped by the stationary barrier which it abuts so as to be available for transfer, as has been hereinbefore described. In the meantime, one of the pushers 12 is about to reach the hopper 20.

Figure 3A:
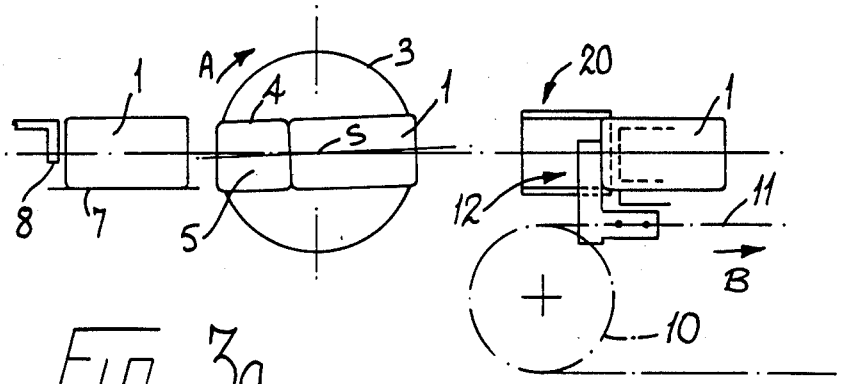
Figure 3B:
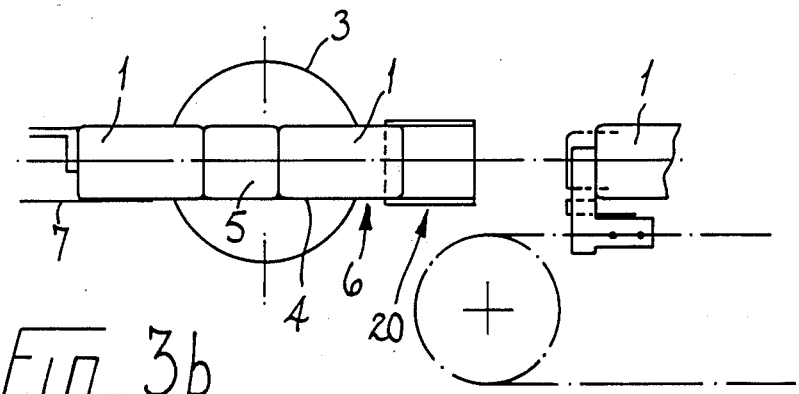
Figure 3C:
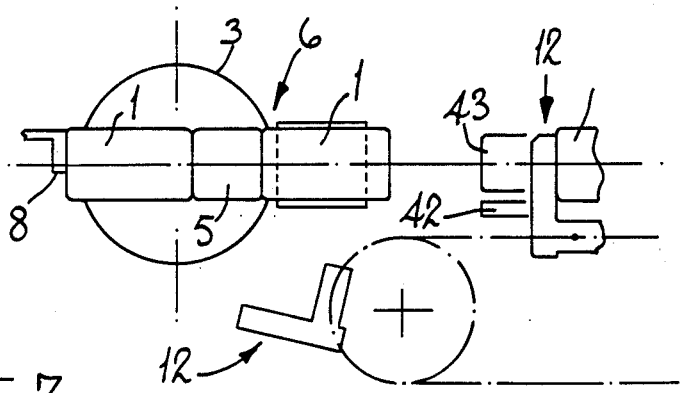

Following the return stroke of the pusher 8 and rotation of the drum 3, the pusher 8 can descend towards its lowest position without contacting the tablet 1 which is to be transferred; in the meantime the hopper 20 has reached its remote position and remains there for a certain length of time (line D4 of D of FIG. 4). Whilst the hopper is stationary, the pusher 12 engages the tablet 1 contained in the hopper 20 and starts to expel it: expulsion is effectively complete when the hopper is about to start its return stroke (FIG. 3*a*). The pusher 12 then propels the tablet 1, withdrawn from the hopper 20, along longitudinal rails 42; as is well known, during this process the end flaps 43*b* and 44*b* of the wrapping paper are engaged by corresponding stationary folders 43 and thus undergo folding and are urged towards one another to be heat sealed together. It can be seen that the receiving and transfer of the tablet 1 with its associated piece of wrapping paper to the transport means is carried out in a controlled and accurate manner.

Having thus described our invention, what we claim as new and desire to secure by Letters Patent of the United States of America is:

1. A machine for wrapping blocks of approximately parallelepiped shape comprising:

(a) an intermittently rotating drum having diametrically opposed seatings for receiving the blocks and performing initial wrapping of said blocks;

(b) a conveyor means for conveying blocks into said drum and including means forcing the partially wrapped blocks out of said drum;

(c) a transfer means for receiving the blocks from said drum;

(d) said transfer means including a hopper and means mounting said hopper for movement from a position receiving the blocks from said drum to downstream position; means to reciprocate said transfer means in a direction radial to said drum to said downstream position; said transfer means including means for further wrapping said blocks;

(e) transport means carried on said mounting means and comprising a conveyor having pushers that contact the wrapped blocks at the downstream position to transport the blocks away from said transfer means for further downstream processing;

(f) said transfer means including a lower support plate and a resiliently mounted upper support plate urged toward said lower support plate and adjustable to vary the spacing between said support plates.

2. The machine of claim 1, wherein said transfer means is mounted for movement along an axis common to both said drum seating and said transport means.

3. The machine of claim 1, wherein said transfer means includes a lower support having two plates projecting from bars mounted on a cross member, said pushers extending between said plates.

* * * * *